US006190244B1

(12) United States Patent
Jung

(10) Patent No.: US 6,190,244 B1
(45) Date of Patent: Feb. 20, 2001

(54) SHARPENING ARRANGEMENT

(75) Inventor: Boudewijn C Jung, Bergen op Zoom (NL)

(73) Assignee: GEC Avery Limited (GB)

( * ) Notice: Under 35 U.S.C. 154(b), the term of this patent shall be extended for 0 days.

(21) Appl. No.: 09/352,269

(22) Filed: Jul. 13, 1999

(30) Foreign Application Priority Data

Jul. 15, 1998 (GB) ..... 9815205

(51) Int. Cl.[7] ..... B24B 9/00
(52) U.S. Cl. ..... 451/293; 451/259
(58) Field of Search ..... 451/190, 193, 451/192, 259, 262, 293; 83/174, 174.1, 932

(56) References Cited

U.S. PATENT DOCUMENTS

| | | | | |
|---|---|---|---|---|
| 2,665,531 | | 1/1954 | Sivertsen . | |
| 3,124,185 | * | 3/1964 | Karp | 83/174 |
| 3,176,560 | * | 4/1965 | Bardenhagen | 83/174 |
| 3,958,478 | * | 5/1976 | Camper | 83/174 |

FOREIGN PATENT DOCUMENTS

| | | |
|---|---|---|
| 580431 | 9/1946 | (GB) . |
| 666121 | 2/1952 | (GB) . |
| 951331 | 3/1964 | (GB) . |
| 1500129 | 2/1978 | (GB) . |
| 2252618A | 8/1992 | (GB) . |

* cited by examiner

*Primary Examiner*—Derris H. Banks
(74) *Attorney, Agent, or Firm*—Kirschstein, et al.

(57) ABSTRACT

A sharpener assembly for a rotating circular knife blade on a food product slicing machine has an elongate frame mounted at one of its ends for pivotal movement about an axis being substantially in the plane of the knife blade. The elongate frame has mounted for rotation thereon a grinding stone and a deburring stone. The grinding face of the grinding stone is inclined to the knife blade at an angle so as to grind a required angle on the edge of the obverse face of the knife blade. The grinding stone and the deburring stone arc mounted so that in use the obverse and reverse faces of the knife blade are respectively engaged.

7 Claims, 7 Drawing Sheets

SHARPENING ARRANGEMENT

FIELD OF THE INVENTION

The present invention relates to a sharpening arrangement for a knife on a slicer for food products, the knife having a rotating circular blade.

BACKGROUND OF THE INVENTION

A sharpening arrangement should desirably have a number of features:

(a) Safety—the hands of the operator should be kept clear of the knife blade, especially the edge, when sharpening;

(b) Aligmnent—ideally the sharpener should be self-aligning to the knife when in use;

(c) Easy to operate—not complicated nor time consuming to use;

(d) Easy to clean.

SUMMARY Of THE INVENTION

According to the present invention there is provided a sharpener assembly for a rotating circular knife blade on a food product slicing machine, the sharpener assembly comprising an elongate frame mounted at one end thereof for pivotal movement about an axis provided by the food product slicing machine, the axis being substantially in the plane of the knife blade, the elongate frame having mounted for rotation thereon a grinding stone and a deburring stone, the grinding face of the grinding stone being inclined to the knife blade at an angle so as to grind a required angle on the edge of the obverse face of the knife blade, the grinding stone and the deburring stone being mounted so that in use the obverse and reverse faces of the knife blade are respectively engaged.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
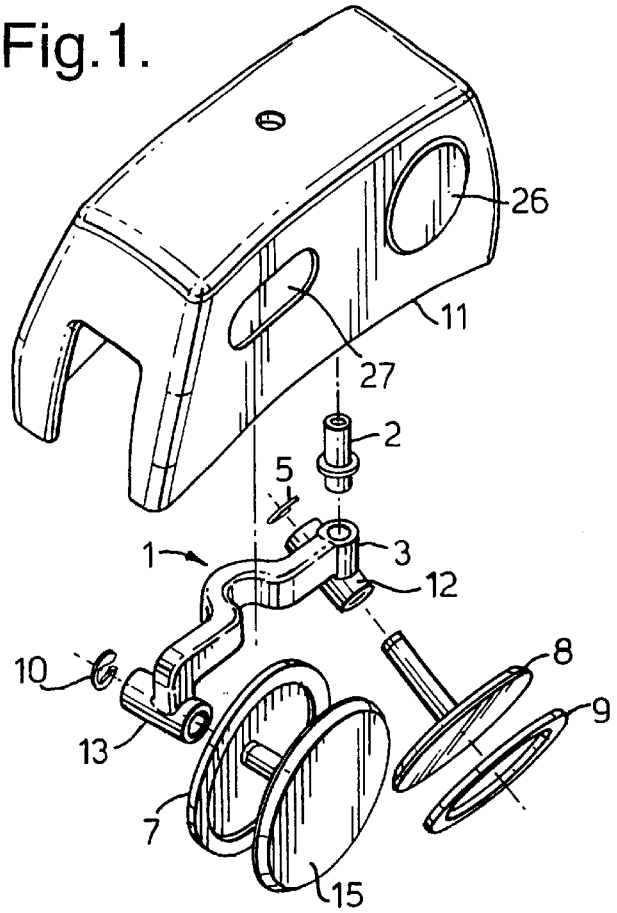
FIG. 1 shows an exploded perspective view of a sharpener assembly according to the present invention.
Figure 4:
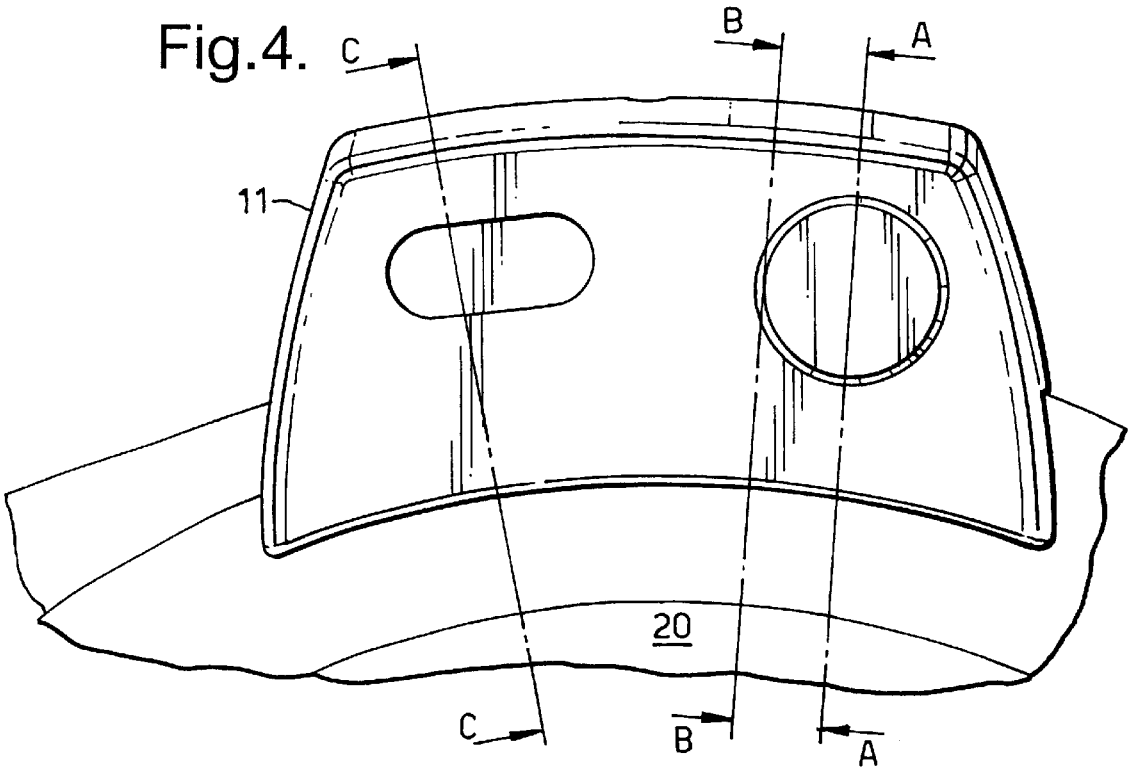
FIG. 4 is a side view of the sharpener assembly of FIG. 3 showing only part of the knife blade.
Figure 2:
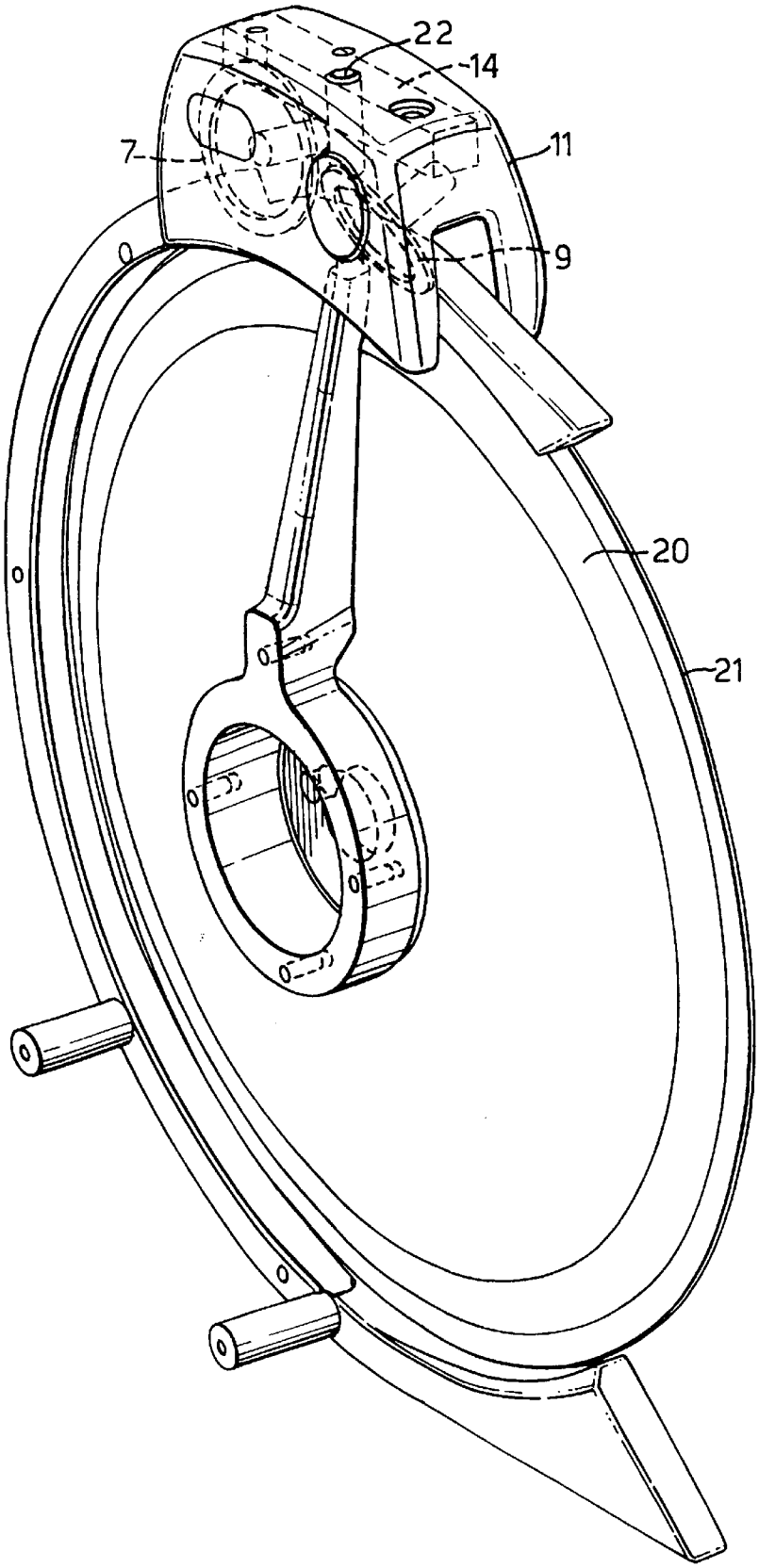
FIG. 2 shows a perspective view of the sharpener assembly of FIG. 1 mounted in the parked position on a circular knife blade.
Figure 3:
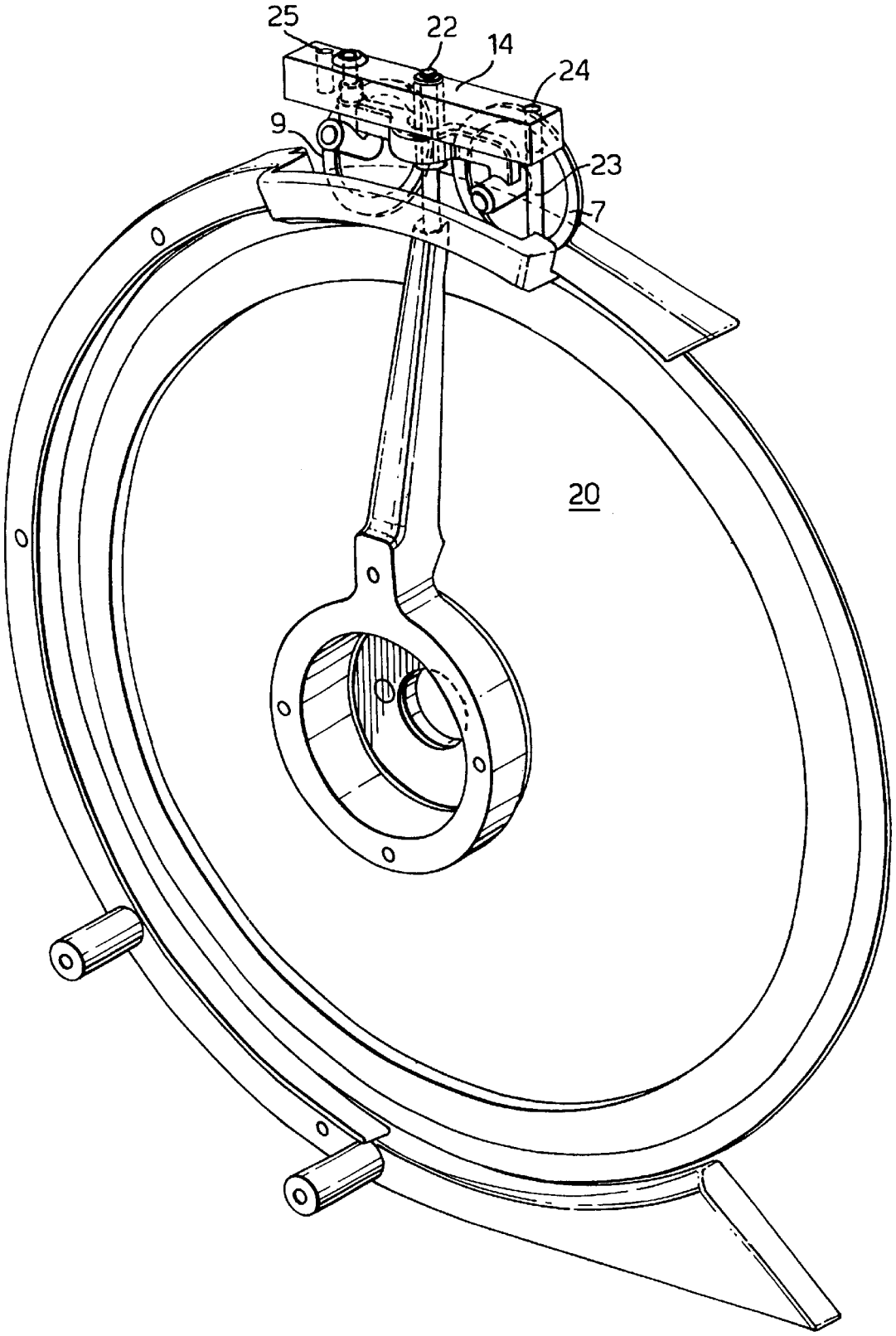
FIG. 3 shows a perspective view of the sharpener assembly of FIGS. 1 and 2 mounted in the sharpening position on a circular knife blade with the cap removed.
Figure 5:
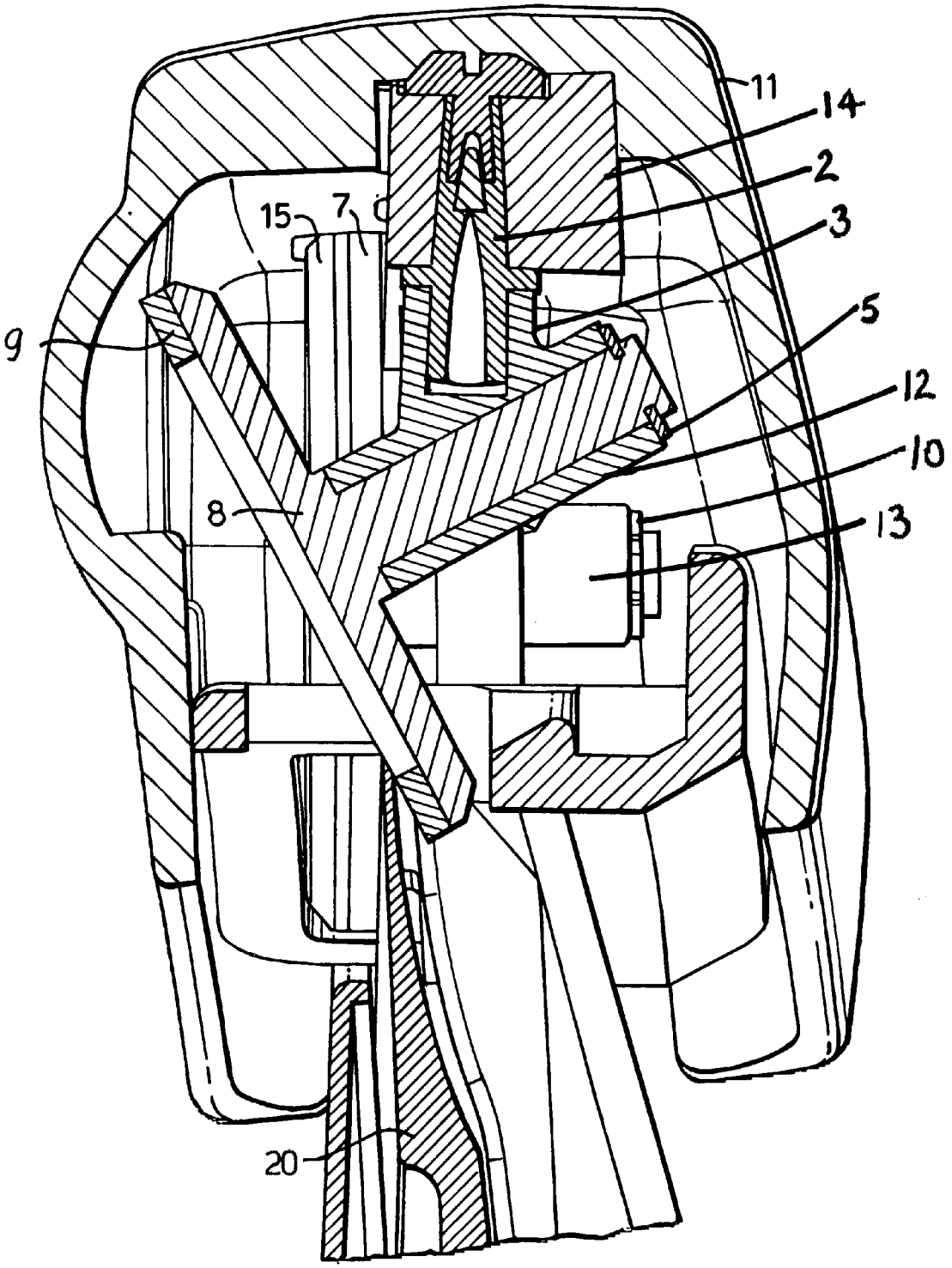
FIG. 5 is a sectional view on the line A—A ot FIG. 4.
Figure 6:
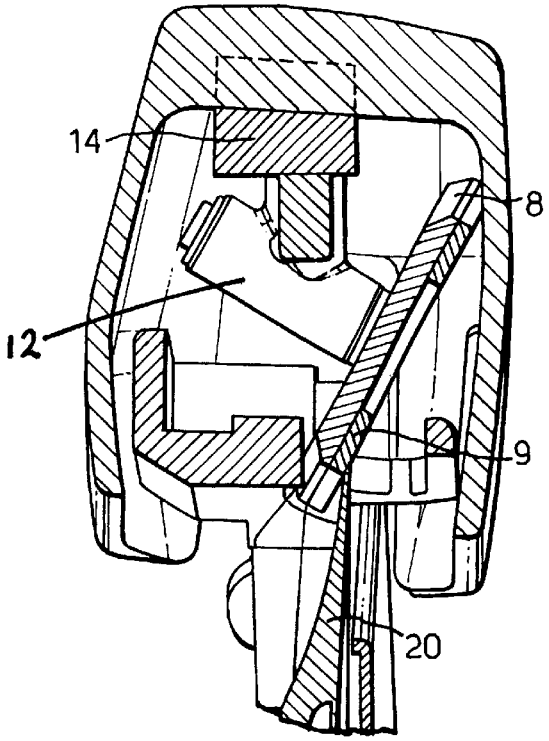
FIG. 6 is a sectional view on the line B—B of FIG. 4.
Figure 7:
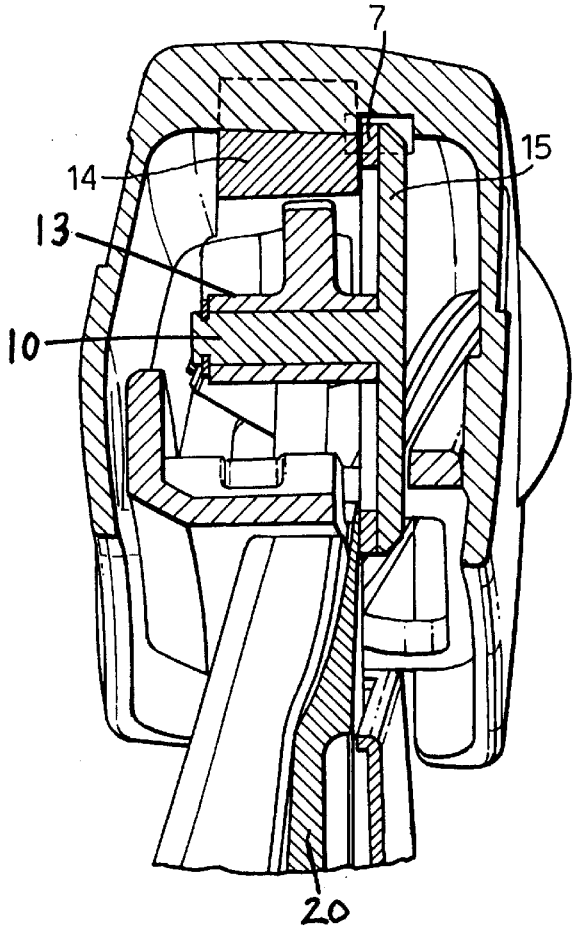
FIG. 7 is a sectional view on the line C—C of FIG. 4.
Figure 8:
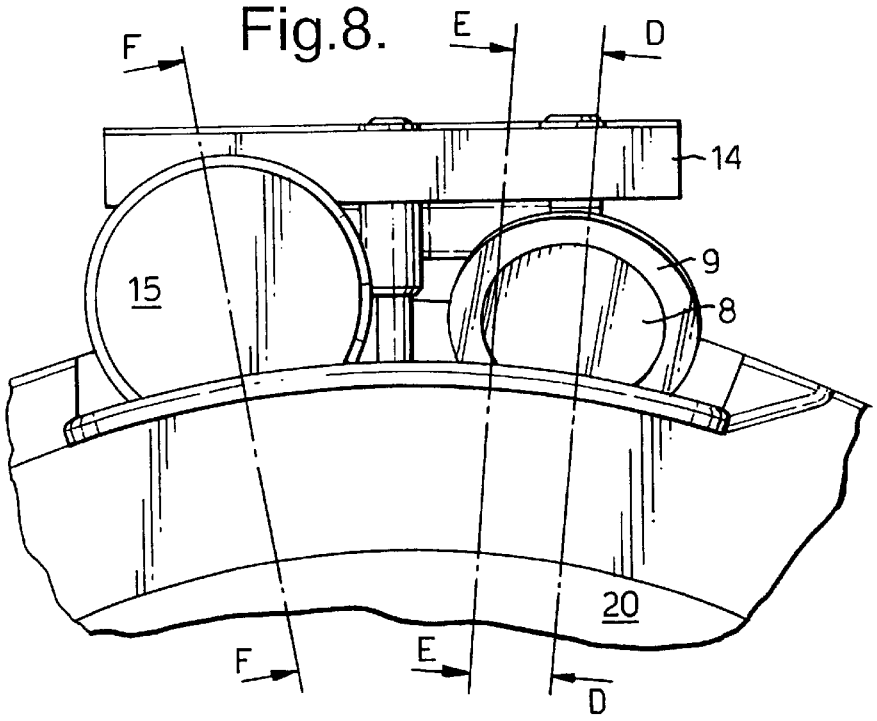
FIG. 8 is a side view of the sharpener of FIG. 4 with the cap removed.
Figure 10:
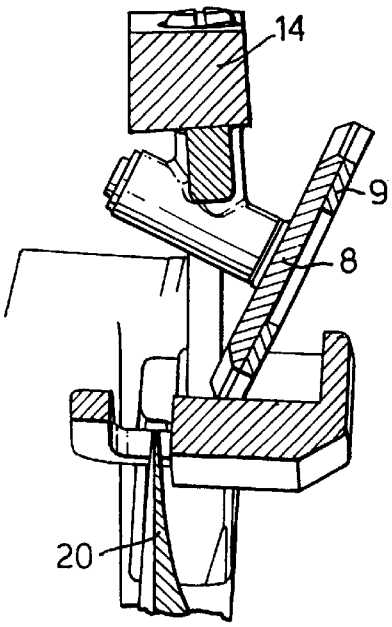
FIG. 10 is a sectional view on the line E—E of FIG. 8 with the sharpener in the parked position.
Figure 11:
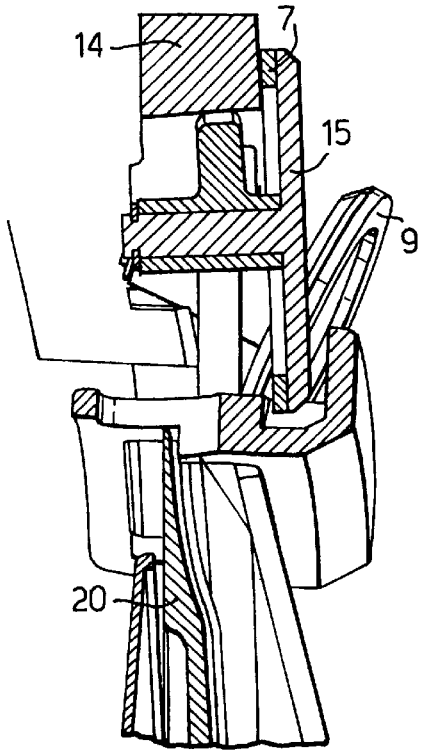
FIG. 11 is a sectional view on the line F—F of FIG. 8 with the sharpener in the parked position.
Figure 9:
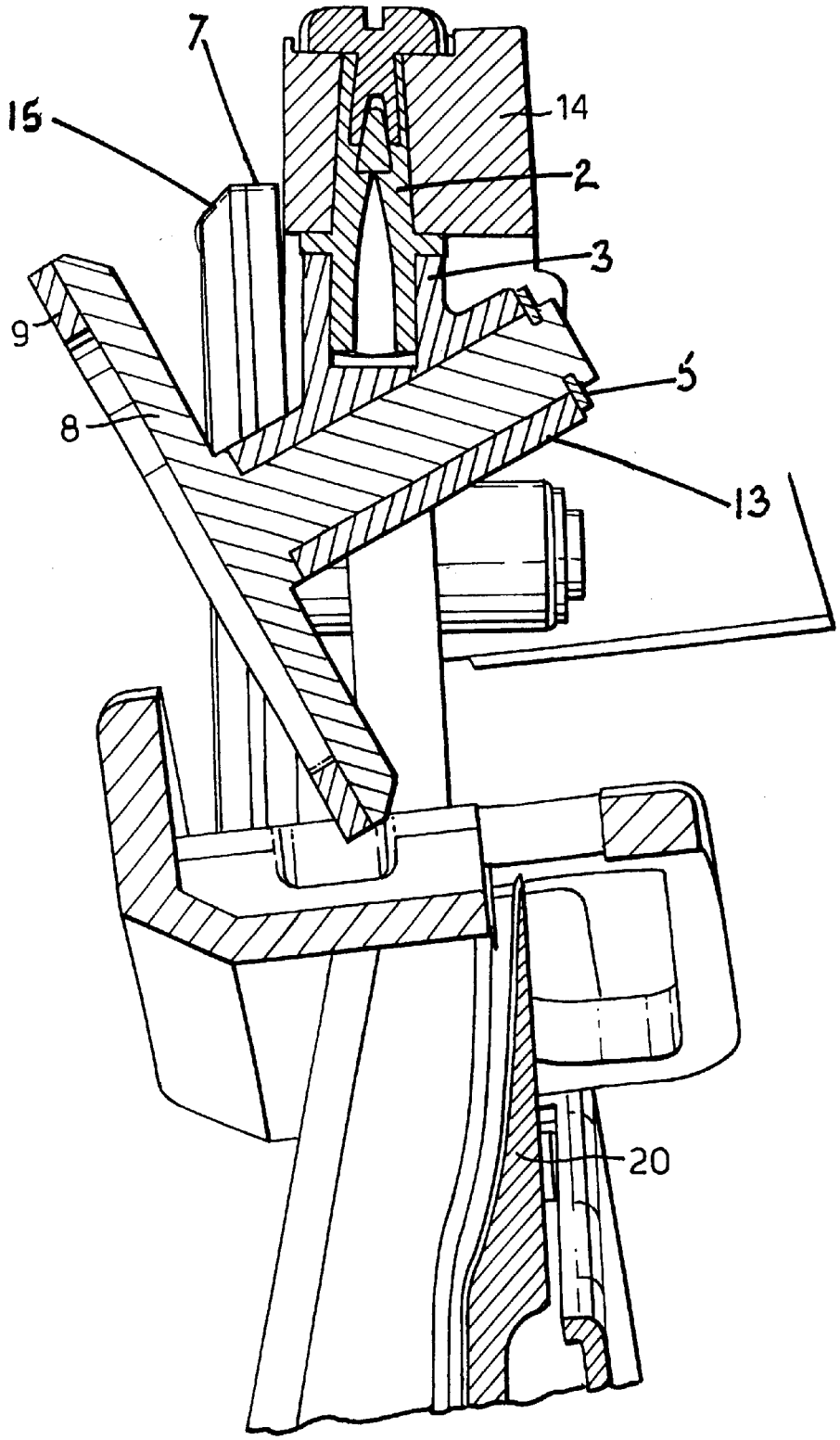
FIG. 9 is a sectional view on the line D—D of FIG. 8 with the sharpener in the parked position.

Considering FIG. 1 in a sharpening assembly 1, a sub-frame 3 has a grinding stone 9 and a deburring stone 7 mounted for rotation thereon. The grinding stone 9 and deburring stone 7 are mounted on a grinding stone support shaft 8 and a deburring stone support shaft 15 respectively, the shafts 7, 8 being mounted in respective bearing sleeves 13, 12 respectively, formed on the sub-frame 3 and retained by respective circlips 10, 5.

The bearing sleeve 12 is formed at such an angle as to grind the correct angle on the obverse side of the knife 20. The sub-frame 3 is mounted in a bearing block 14 by a pin 2 permitting angular rotation of the sub-frame 3 thereabout. The axis of the pin 2 should preferably pass close to the axis of grinding stone shaft 8.

Because of the grinding force on the grinding stone. 9 the sub-frame 3 tends to rotate about the pin 2 bringing the deburring stone into contact with the other face of the blade.

The location of the grinding areas on the knife 20 is between the axis of the pin 2 and of the location deburring area on the knife 20. The ratio of the distances of the deburring area and the grinding area from the axis of the pin 2 should be such as to keep the axial force on the deburring stone low to prevent the burning of the edge 21 of the knife 20, a ratio of approximately 3:1 being suggested.

The bearing block 14 is fitted in a cover 11 which protects the access opening to the knife 20 and the sharpening assembly 1. The bearing block 14 is mounted to slide axially on a guide on 22 mounted radially of the knife blade 20. The axis is parallel to the reverse face of the blade 20 to avoid the necessity of adjusting the sharpening assembly 1 due to wear of the knife blade 20. The bearing block 14 may be lifted away from the knife blade 20 and rotated through 180° between two positions, a first, parking position where the grinding stone 9 and the deburring stone 7 are out of engagement with the knife blade 20 and a second, grinding position where the grinding stone 9 and the deburring stone 7 are in the operative positions for carrying out the sharpening procedure.

These first and second positions are defined by a locating pin 23 engaging in respective holes 24, 25 in the bearing block 14.

Control of the grinding process is by the application of a force to the sharpening assembly 1 along the axis of the guide pin 22.

Rotation of the grinding stone 9 and the deburring stone 7 are caused by tangential movement of the rotating knife blade 20 there across.

In an alternative arrangement the sharpening assembly 1 could be mounted for pivotal movement in the plane of the knife blade 20 so as to engage the knife blade.

What I claim is:

1. In a food product slicing machine, a sharpener assembly for a circular knife blade rotatable about a rotary axis, lying in a plane and having opposite blade faces, the assembly comprising:

a) an elongated frame mounted for pivoting movement about a pivot axis that lies substantially in the plane of the blade;

b) a grinding stone mounted on the frame for turning movement about a grinding axis;

c) a deburring stone mounted on the frame for turning movement about a deburring axis, and being spaced apart from the grinding stone;

d) the frame and the stones being mounted for joint radial movement toward the rotary axis to a sharpening position in which the stones respectively overlie the blade faces; and e) the frame and the stones being pivoted about the pivot axis during the joint radial movement to the sharpening position for respectively urging the stones into contact with the blade faces.

2. The assembly of claim 1, wherein the frame has opposite end regions, and wherein the stones are respectively mounted at the end regions.

3. The assembly of claim 1, wherein the grinding and deburring axes are inclined relative to each other.

4. The assembly of claim 1, wherein the deburring axis is oriented generally parallel to the rotary axis.

5. The assembly of claim 1, wherein the frame includes a pair of bearing sleeves, and wherein the stones are mounted on respective shafts journaled in the sleeves.

6. The assembly of claim 1, and further comprising a bearing block having a socket in which a pin is journaled, and wherein the pin extends along the pivot axis.

7. The assembly of claim 6, and further comprising a cover fitted onto the bearing block.

* * * * *